US009122219B2

(12) United States Patent
Ikeda et al.

(10) Patent No.: US 9,122,219 B2
(45) Date of Patent: Sep. 1, 2015

(54) RECORDING MEDIUM PLACEMENT DEVICE AND IMAGE FORMING APPARATUS

(71) Applicants: Yuji Ikeda, Kanagawa (JP); Hiroshi Adachi, Kanagawa (JP)

(72) Inventors: Yuji Ikeda, Kanagawa (JP); Hiroshi Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/305,394

(22) Filed: Jun. 16, 2014

(65) Prior Publication Data

US 2015/0023709 A1 Jan. 22, 2015

(30) Foreign Application Priority Data

Jul. 17, 2013 (JP) ..... 2013-148867

(51) Int. Cl.
*G03G 15/00* (2006.01)
*B65H 9/10* (2006.01)

(52) U.S. Cl.
CPC ..... *G03G 15/607* (2013.01); *B65H 9/101* (2013.01); *G03G 15/605* (2013.01); *G03G 15/6502* (2013.01); *G03G 15/6552* (2013.01)

(58) Field of Classification Search
CPC ... G03G 15/00; G03G 21/00; G03G 15/6552; G03G 15/6502; G03G 15/605; G03G 15/607; B65H 9/00; B65H 9/10; B65H 9/101
USPC ..... 399/389, 392, 393; 271/250, 253, 145, 271/171
See application file for complete search history.

(56) References Cited

U.S. PATENT DOCUMENTS

| | | | | |
|---|---|---|---|---|
| 4,908,673 | A | 3/1990 | Muramatsu | |
| 2009/0121412 | A1 | 5/2009 | Koyanagi | |
| 2011/0024977 | A1 | 2/2011 | Koyanagi | |
| 2011/0175282 | A1 | 7/2011 | Sagawa et al. | |
| 2013/0200565 | A1 | 8/2013 | Takenaka et al. | |
| 2013/0270765 | A1* | 10/2013 | Araaki et al. | 271/171 |
| 2013/0341854 | A1* | 12/2013 | Miyakawa et al. | 271/145 |
| 2014/0015192 | A1 | 1/2014 | Wakabayashi et al. | |

FOREIGN PATENT DOCUMENTS

| | | | |
|---|---|---|---|
| EP | 2 345 608 | A | 7/2011 |
| JP | 60-178143 | A | 9/1985 |
| JP | 62-60726 | A | 3/1987 |
| JP | 3969215 | | 9/2007 |
| JP | 2011-042479 | | 3/2011 |
| JP | 2012-193013 | | 10/2012 |

OTHER PUBLICATIONS

U.S. Appl. No. 14/296,988, filed Jun. 5, 2014.
U.S. Appl. No. 14/073,992, filed Nov. 7, 2013.
Extended European Search Report issued Nov. 19, 2014 in Patent Application No. 14176967.9.

* cited by examiner

*Primary Examiner* — Nguyen Ha
(74) *Attorney, Agent, or Firm* — Oblon, McClelland, Maier & Neustadt, L.L.P.

(57) ABSTRACT

A recording medium placement device includes a placement unit in which a recording medium is placed; a guide member provided along an edge of the recording medium and movable in a first direction orthogonal to the edge, the edge being at a first position; a distance detection unit that detects a distance between the guide member and the edge; a drive unit that moves the guide member in the first direction until the distance detection unit detects that the guide member contacts the recording medium; a gap length calculation unit that calculates a length of a gap between the recording medium and the guide member when a movement of the guide member is stopped using a detection output from the distance detection unit; and an adjustment unit that moves the guide member to the edge at the first position based on the length of the gap.

5 Claims, 6 Drawing Sheets

| APPARATUS A | |
|---|---|
| t (mm) | DETECTION OUTPUT OF DISTANCE SENSOR y (V) |
| 0.0 | 4.0 |
| 1.0 | 3.5 |
| 2.0 | 3.0 |
| 3.0 | 2.5 |
| ▪ | ▪ |
| ▪ | ▪ |
| ▪ | ▪ |

| APPARATUS B | |
|---|---|
| t (mm) | DETECTION OUTPUT OF DISTANCE SENSOR y (V) |
| 0.0 | 3.5 |
| 1.0 | 3.1 |
| 2.0 | 2.7 |
| 3.0 | 2.3 |
| ▪ | ▪ |
| ▪ | ▪ |
| ▪ | ▪ |

RECORDING MEDIUM PLACEMENT DEVICE AND IMAGE FORMING APPARATUS

BACKGROUND OF THE INVENTION

1. Field of the Invention

The disclosures herein generally relate to a recording medium placement device and an image forming apparatus.

2. Description of the Related Art

An image forming apparatus such as a copy machine or a facsimile machine is provided with a paper placement device in which a paper is placed, as a recording medium placement device in which a recording medium is placed. That is, for example, it is provided with a paper feed cassette in which a print paper is placed or a manuscript tray in which a read manuscript is set. These paper placement devices include movable opposing guide members (side fence) in order to prevent a print failure or a paper feed failure arising from an irregularity of the placed paper (print paper or read manuscript).

These guide members are configured so as to move by the same distance in conjunction with each other in opposite directions to each other along a width direction of the paper (a direction orthogonal to a paper feed direction or a transportation direction). Manual type guide members which are moved by a user manually are common. But, automated guide members so as to simplify the user's operation are also known. That is, Japanese Patent No. 3969215 describes controlling so that two guide members are moved in directions to approach each other automatically from initial positions when a manuscript is placed and the guide members are stopped when the guide members contact the paper.

However, the automatic control of guide members described in Japanese Patent No. 3969215 is control where contact of the guide members with the paper is detected and the guide members are stopped immediately. Accordingly, the automatic control of guide members in Japanese Patent No. 3969215 has a problem that a positional relationship of the paper and the guide members may not be appropriate due to a detection error of a detection mechanism for the contact of the guide members with the paper, by which a difference in the stop positions of the guide members between devices may occur.

That is, the positional relationship becomes a remote positional relationship where a gap appears between the paper and the guide members or a too close positional relationship where the paper is held between the guide members and is deflected.

SUMMARY OF THE INVENTION

It is a general object of at least one embodiment of the present invention to provide a recording medium placement device and an image forming apparatus that substantially obviate one or more problems caused by the limitations and disadvantages of the related art.

In one embodiment, a recording medium placement device includes a placement unit in which a recording medium is placed; a guide member provided on the placement unit and along an edge of the recording medium placed on the placement unit and movable in a first direction orthogonal to the edge so that the guide member approaches the recording medium and in a second direction opposite to the first direction, the edge being at a first position; a distance detection unit that detects a distance between the guide member and the edge of the recording medium; a drive unit that moves the guide member in the first direction until the distance detection unit detects that the guide member contacts the recording medium; a gap length calculation unit that calculates a length of a gap between the recording medium and the guide member when a movement of the guide member is stopped using a detection output from the distance detection unit; and an adjustment unit that moves the guide member to the edge of the recording medium at the first position based on the length of the gap calculated by the gap length calculation unit.

In another embodiment, an image forming apparatus includes the recording medium placement device; and an image forming unit that forms an image on a recording medium fed from the recording medium placement device. The recording medium placement device includes a placement unit in which the recording medium is placed; a guide member provided on the placement unit and along an edge of the recording medium placed on the placement unit and movable in a first direction orthogonal to the edge so that the guide member approaches the recording medium and in a second direction opposite to the first direction, the edge being at a first position; a distance detection unit that detects a distance between the guide member and the edge of the recording medium; a drive unit that moves the guide member in the first direction until the distance detection unit detects that the guide member contacts the recording medium; a gap length calculation unit that calculates a length of a gap between the recording medium and the guide member when a movement of the guide member is stopped using a detection output from the distance detection unit; and an adjustment unit that moves the guide member to the edge of the recording medium at the first position based on the length of the gap calculated by the gap length calculation unit.

According to the present invention, in the recording medium placement device, the positional relationship between the placed recording medium and the guide members can be made appropriate.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

<Configuration of Image Forming Apparatus>

Figure 1:
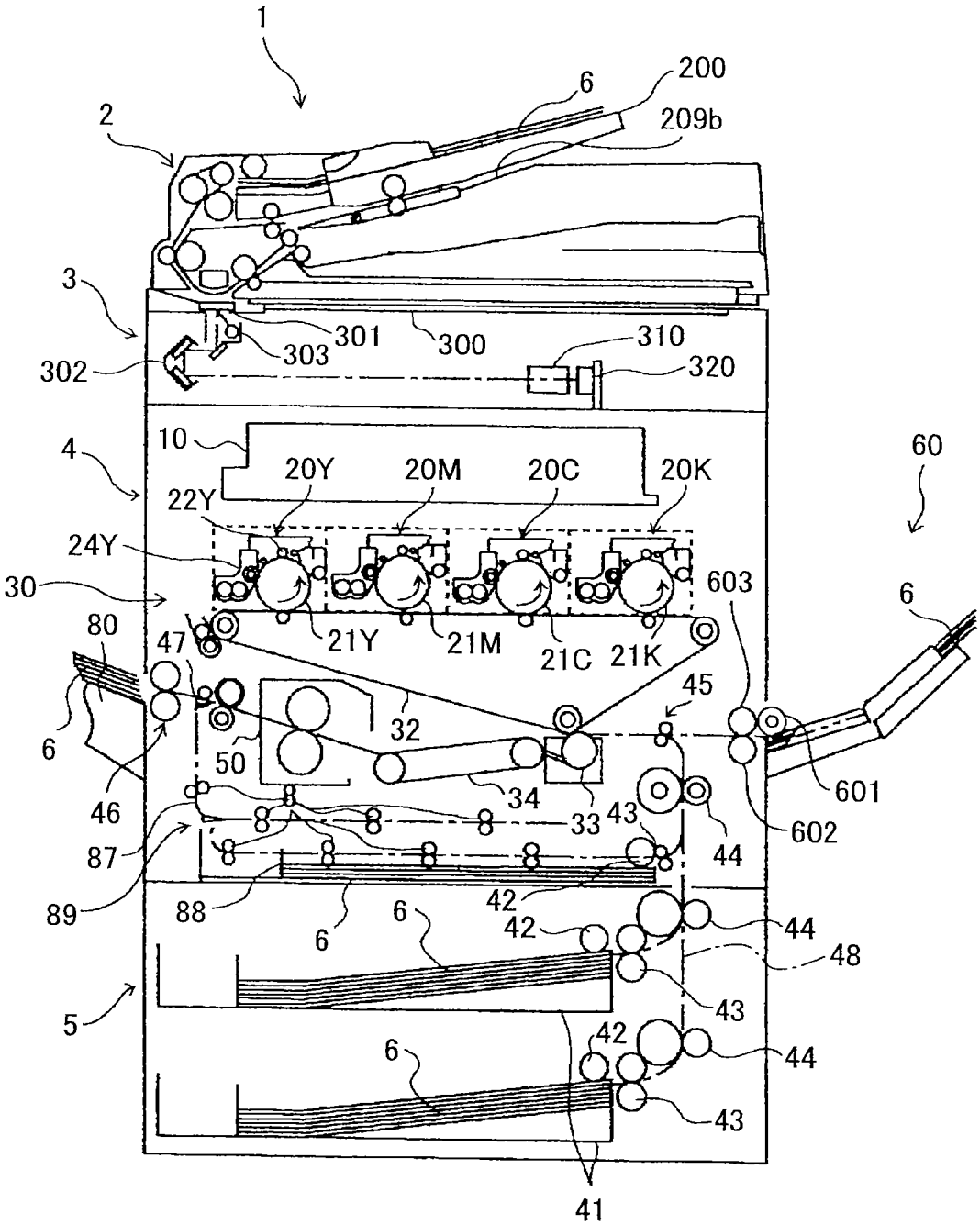
FIG. 1 is an explanatory diagram illustrating an example of a configuration of an image forming apparatus according to the present embodiment.

FIG. 1 is an explanatory diagram illustrating a configuration of an image forming apparatus according to the present embodiment. The image forming apparatus 1 is a copy machine including an automatic document feeder (ADF) 2, a scanner 3, an image forming unit 4 and a paper feed unit 5.

The paper feed unit 5 includes a paper feed cassette 41 for storing a paper 6 as a print paper on which an image is formed. Moreover, the image forming unit 4 includes four process cartridges 20Y, 20M, 20C and 20K for forming images of yellow (Y), magenta (M) and cyan (C) and black (K), respectively.

The image forming unit 4, roughly in the central portion in a vertical direction, has a transcription device 30. The transcription device 30 includes an intermediate transcription belt 32, which is endless, as a transcriptional body and plural rollers arrange inside a loop of the intermediate transcription belt 32, which is stretched in an inverted triangle by the plural rollers. At each vertex of the inverted triangle, a support roller wraps the intermediate transfer belt 32 on a roller periphery with a large wrapping angle. One of the three support rollers moves the intermediate transfer belt 32 by its rotary drive in the clockwise direction in the drawing endlessly.

A belt cleaning device contacts from outside the loop a belt wrapping part for the support roller which is provided at the leftmost portion in the drawing among the three support rollers. The belt cleaning device removes residual toner attached to a surface of the intermediate transfer belt 32 after passing through a secondary transfer nip, which will be described later, from the surface of the belt.

A belt region, after passing through the contact position with the support roller provided in the leftmost portion in the drawing, and before entering the contact position with the support roller provided in the rightmost portion in the drawing, is a horizontally advancing region that progresses straight along a roughly horizontal direction. Above the horizontally advancing region, the four process cartridges 20Y, 20M, 20C and 20K for yellow, magenta, cyan and black are provided so as to be arranged in this order along the belt transportation direction. The process cartridges 20Y, 20M, 20C and 20K generate yellow, magenta, cyan and black toner images respectively which are overlapped and transferred onto the intermediate transfer belt 32 are formed. The image forming apparatus in the present embodiment has a so-called tandem type configuration in which yellow, magenta, cyan and black toner images are formed by the process cartridges 20Y, 20M, 20C and 20K parallel to each other. Meanwhile, in the image forming apparatus, an order of arrangement of colors yellow, magenta, cyan and black is employed, but the order of arrangement of colors is not limited to the above order.

In the image forming unit 4, the respective process cartridges 20Y, 20M, 20C and 20K are provided with photoreceptors 21Y, 21M, 21C and 21K, having shapes of a drum, as image supports. Around the photoreceptors a charging device (22Y or the like), a development device (24Y or the like), a photoreceptor cleaning device, a neutralization device and the like is provided.

Above the four process cartridges 20Y, 20M, 20C and 20K, an exposure device 10 is provided. A latent image forming unit that forms an electrostatic latent image on the photoreceptor 21Y, 21M, 21C and 21K is configured by the exposure device 10 and the charging devices for yellow, magenta, cyan and black. The exposure device 10 optically scans the surfaces of the photoreceptors 21Y, 21M, 21C and 21K after a uniform charging by writing light for yellow, magenta, cyan and black generated based on image information obtained by the scanner 3 reading an image or image information sent from an external personal computer or the like.

The electrostatic latent images for yellow, magenta, cyan and black supported on the surfaces of the photoreceptors 21Y, 21M, 21C and 21K are visualized as yellow, magenta, cyan and black toner images by the development device attaching yellow, magenta, cyan and black toners. The photoreceptors 21Y, 21M, 21C and 21K contact the intermediate transfer belt 32 to form corresponding primary transfer nips. On the back sides of the first transfer nips for yellow, magenta, cyan and black, primary transfer rollers for yellow, magenta, cyan and black arranged inside the loop of the intermediate transfer belt 32 hold the intermediate transfer belt 32 by the photoreceptors 21Y, 21M, 21C and 21K. At the primary transfer nip for yellow, the yellow toner image formed on the photoreceptor 21Y is transferred primarily to the front side of the intermediate transfer belt 32. The surface of the belt 32 on which the yellow toner image is primarily transferred as above passes through the first transfer nips for magenta, cyan and black in turn. In the process, magenta, cyan and black toner images on the photoreceptors 21M, 21C and 21K are primarily transferred and overlaid serially, and a color toner image is formed on the surface of the belt 32.

On the surfaces of the photoreceptors 21Y, 21M, 21C and 21K after passing through the primary transfer nips for yellow, magenta, cyan and black, the transfer residual toners are removed by the photoreceptor cleaning device. Then, the surfaces are neutralized by the neutralization device, and prepared for another image formation.

A secondary transfer roller 33, as a secondary transfer unit, is contacted from outside the loop by the belt wrapping part for the support roller which is provided at the lowermost portion in the drawing among the three support rollers arranged inside the loop of the intermediate transfer belt 32, and a secondary transfer nip is formed.

On the right laterally of the secondary transfer nip in the drawing, resist rollers 45 is arranged, the rollers 45 rotating in forward directions while contacting each other to form a resist nip. The paper 6 sent from the paper feed unit 5, which will be described later, is held by the resist nip of the resist rollers 45. The paper 6 is sent by the resist rollers 45 toward the secondary transfer nip at a timing synchronized with the color toner image on the intermediate transfer belt 32. To the paper 6 held by the secondary transfer nip, the color toner image on the intermediate transfer belt 32 is secondarily transferred by an action of an electric field of the secondary transfer nip or nip pressure. The paper 6, on which the color toner image is secondarily transferred as above, is sent from the secondary transfer nip, via a transportation belt 34 which moves endlessly, into a fixing device 50. The fixing device 50 performs a fixing process for a toner image by heating or pressing the paper 6 held in a fixing nip which is formed by a fixing roller and a pressing roller as fixing members.

The paper 6 sent from the fixing device 50 comes to a branch point on the conveyance path where a conveyance path switch claw 47 is arranged. The conveyance path switch claw 47 switches between an exit path and an inverted conveyance path 87 as a sheet conveyance path on a downstream side from the branch point. In the case where a single-sided print mode is selected for the print operation mode, the conveyance path switch claw 47 selects the exit path for the sheet conveyance path. Moreover, also in the case where a double-sided print mode is selected and the paper 6 sent from the secondary transfer nip supports toner images on both sides respectively, the conveyance path switch claw 47 selects the exit path for the sheet conveyance path. The paper 6 which enters into the exit path goes through an exit nip of exit roller 46 and is ejected outside the apparatus. The paper 6 is stacked on a paper ejection tray 80 which is fixed on a lateral surface of a chassis.

On the other hand, in the case where the double-sided print mode is selected and the paper 6 sent from the secondary transfer nip supports a toner image only on a first side, the conveyance path switch claw 47 selects the inverted conveyance path 87 for the sheet conveyance path. Accordingly, in the double-sided print mode, the paper 6 which supports a toner image only on the first side after being sent from the fixing device 50, enters into the inverted conveyance path 87. On the inverted conveyance path 87 an inverted conveyance device 89 is arranged. The inverted conveyance device 89, while inverting vertically the paper 6 sent from the fixing device 50, stacks the paper 6 temporarily in a relay tray 88 or transfers the paper 6 again to the resist nip of the resist rollers 45. When the paper 6 returned to a paper feed path 48 by the inverted conveyance device 89 goes from the resist rollers 45 through the secondary transfer nip again, and a toner image is secondarily transferred also on a second side. The paper 6 again goes through the fixing device 50, the conveyance path switch claw 47, the exit path and the exit roller 46 serially, and is stacked on the paper ejection tray 80.

The paper feed unit 5 provided just under the image forming unit 4 includes two of the paper feed cassettes 41 which are piled in a vertical direction, the paper feed path 48, plural pairs of conveyance rollers 44 and the like. The paper feed cassette 41 as the paper placement device can be detached by sliding in the longitudinal direction with respect to the chassis of the paper feed unit 5 (in a direction orthogonal to the plane of paper). To a bundle of paper 6 in the paper feed cassette 41 placed in the chassis of the paper feed unit 5, a paper feed roller 42 supported by a support unit in the chassis is pressed. When the paper feed roller 42 drivingly rotates in the above state, an uppermost paper 6 of the paper bundle is sent to the paper feed path 48. The sent paper 6, before reaching the paper feed path 48, enters a conveyance separation nip by contact of the conveyance rollers 44 with separation rollers 43. The paper 6 is sent to the paper feed path 48 finally in a state of being separated as a single sheet. The paper 6 goes through conveyance nips at respective pairs of conveyance rollers 44, and reaches the resist nip of the resist rollers 45 of the image forming unit 4.

The right side of the chassis of the image forming unit 4 in the drawing supports a manual paper feed tray 60 as a paper placement device. The manual paper feed tray 60 presses a manual paper feed roller 601 to an uppermost paper 6 on the bundle of the paper 6 placed on a sheet placement surface. According to the driving rotation of the manual paper feed roller 601, the uppermost paper 6 is sent to the resist rollers 45. The sent paper 6, before reaching the resist rollers 45, passes through the conveyance separation nip by the contact of a conveyance roller 603 with a separation roller 602, and is separated in a sheet.

The scanner 3 includes a travelling body 302, an imaging lens 310, an image readout sensor 320 and the like below a first contact glass 300 or a second contact glass 301. Moreover, the travelling body includes a scanning lamp 303 or plural reflection mirrors, and can be moved in a horizontal direction in the drawing by a drive mechanism, which is not shown. Light emitted from the scanning lamp 303 is reflected by an image surface of a manuscript placed on the first contact glass 300 or by an image surface of a manuscript which is conveyed on the second contact glass 301, and becomes image readout light. The image readout light is reflected by plural reflection mirrors provided in the travelling body 302, reaches the image readout sensor 320 including a CCD (charge coupled device) or the like via the imaging lens 310 fixed at the scanner main body, and produces an image at a focus position in the sensor 320. Accordingly, an image of the manuscript is read out.

In the case of reading out the image of the paper placed in the ADF (automatic document feeder) 2, the scanner 3, while making the travelling body stay at the position as shown in FIG. 1, turns on the scanning lamp 303 and emits light from the scanning lamp 303 to the second contact glass 301. Then, the ADF 2 starts conveying the paper 6 placed on a manuscript tray 200 as a paper placement device, and brings the paper 6 just above the second contact glass 301 of the scanner 3. Accordingly, in a state where the travelling body 302 stops, an image on the paper 6 is read out sequentially from the front-end side to the back-end side in the conveyance direction. The paper 6 which has been read out moves to a paper ejection tray 209*b* and is stacked on it.

<Configuration of Paper Placement Device>

Figure 2:
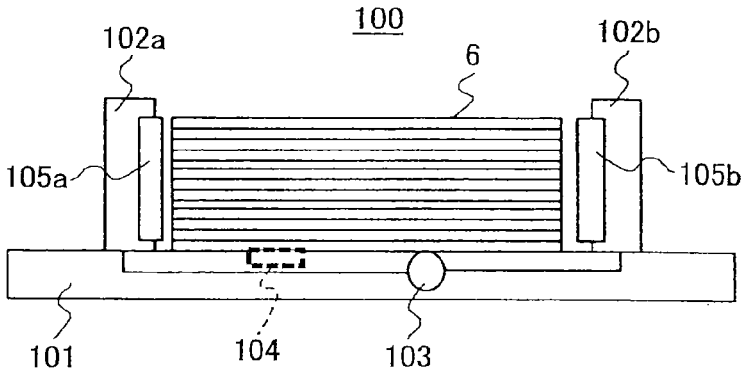
FIG. 2 is an explanatory diagram illustrating an example of a configuration of a paper placement device according to the present embodiment.

FIG. 2 is an explanatory diagram illustrating a configuration of a paper placement device 100 according to the present embodiment. The paper placement device 100 may be configured to be the manuscript tray 200, the manual paper feed tray 60 or the paper feed cassette 41, as shown in FIG. 1.

The paper placement device 100 as the recording medium placement device includes a paper platform 101 as a placement unit on which paper 6 is placed; opposing side fences 102*a*, 102*b* as guide members to fix (regulate) the position and the direction of the paper 6 in order to prevent a paper feed failure; and a side fence drive motor 103 for moving the side fences 102*a* and 102*b*. Moreover, the paper placement device 100 further includes a paper placement sensor 104 as the recording medium detection unit for detecting that a paper 6 as the recording medium is placed; and distance sensors 105*a*, 105*b* as a distance detection unit that can detect respective distances between the paper 6 and the side fences 102*a*, 102*b*.

When a detection output from the distance sensors 105*a* and 105*b* indicates a distance of zero, the distance sensors detect that the paper 6 contacts the side fences 102*a* and 102*b*. For such distance sensors 105*a*, 105*b*, a magnetic sensor including a Hall element and a magnet, or an optical sensor having a light emitting element and a light receiving element may be used. Meanwhile, in the present embodiment, the contact is detected based on the detection output of distance of zero from the distance sensor. But, a contact sensor may be provided other than the distance sensor, and the contact (distance of zero) may be detected according to the detection output from the contact sensor. In this case, the distance detection unit includes the distance sensor and the contact sensor.

Moreover, in the paper placement device 100, according to a control by a CPU (Central Processing Unit) 111 (FIG. 3), which will be described later, the side fence drive motor 103 is rotated so that the side fences 102*a* and 102*b* move in opposite directions to each other by the same distance. Based on the detection output from the distance sensors 105*a* and 105*b*, a direction of rotation and an amount of rotation of the side fence drive motor 103 are set so as to control positions of the side fences 102*a* and 102*b* accurately, thereby more appropriate position control for paper alignment is realized. Accordingly, for the side fence drive motor 103, a stepping motor or a motor having an encoder detection function is preferably used.

The distance sensors 105*a* and 105*b* are attached to the side fences 102*a* and 102*b* via movable members such as springs, which are not shown. When the side fences 102*a* and 102*b* do not contact the paper 6, as shown in FIG. 2, the distance sensors 105*a* and 105*b* protrude from surfaces of the side fences 102*a* and 102*b* toward the paper 6. When the side fences 102*a* and 102*b* approach each other, by being pushed by the paper 6, the distance sensors 105*a* and 105*b* retract to positions of the surfaces of the side fences 102*a* and 102*b* (See FIGS. 5A and 5B, which will be described later).

Figure 3:
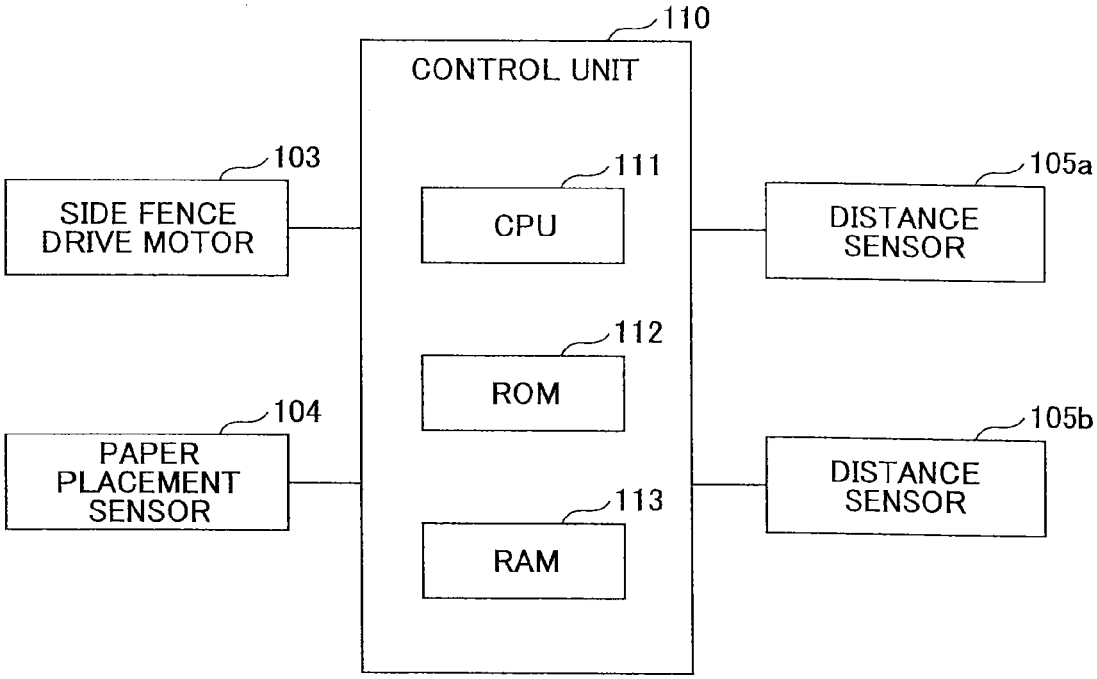
FIG. 3 is an explanatory block diagram illustrating an example of a configuration of a control system of the paper placement device according to the present embodiment.

FIG. 3 is an explanatory block diagram illustrating a configuration of a control system of the paper placement device 100. As shown in FIG. 3, the side fence drive motor 103, the paper placement sensor 104, and the distance sensors 105*a* and 105*b* are connected to a control unit 110 which includes a CPU 111, a ROM (Read-Only Memory) 112 and a RAM (Random Access Memory) 113. The control unit 110, by processing a program stored in the ROM 112 and a hard disk (not shown) in the image forming apparatus 1, executes a paper automatic placement operation.

<Operation of Paper Placement Device>

Figure 4:
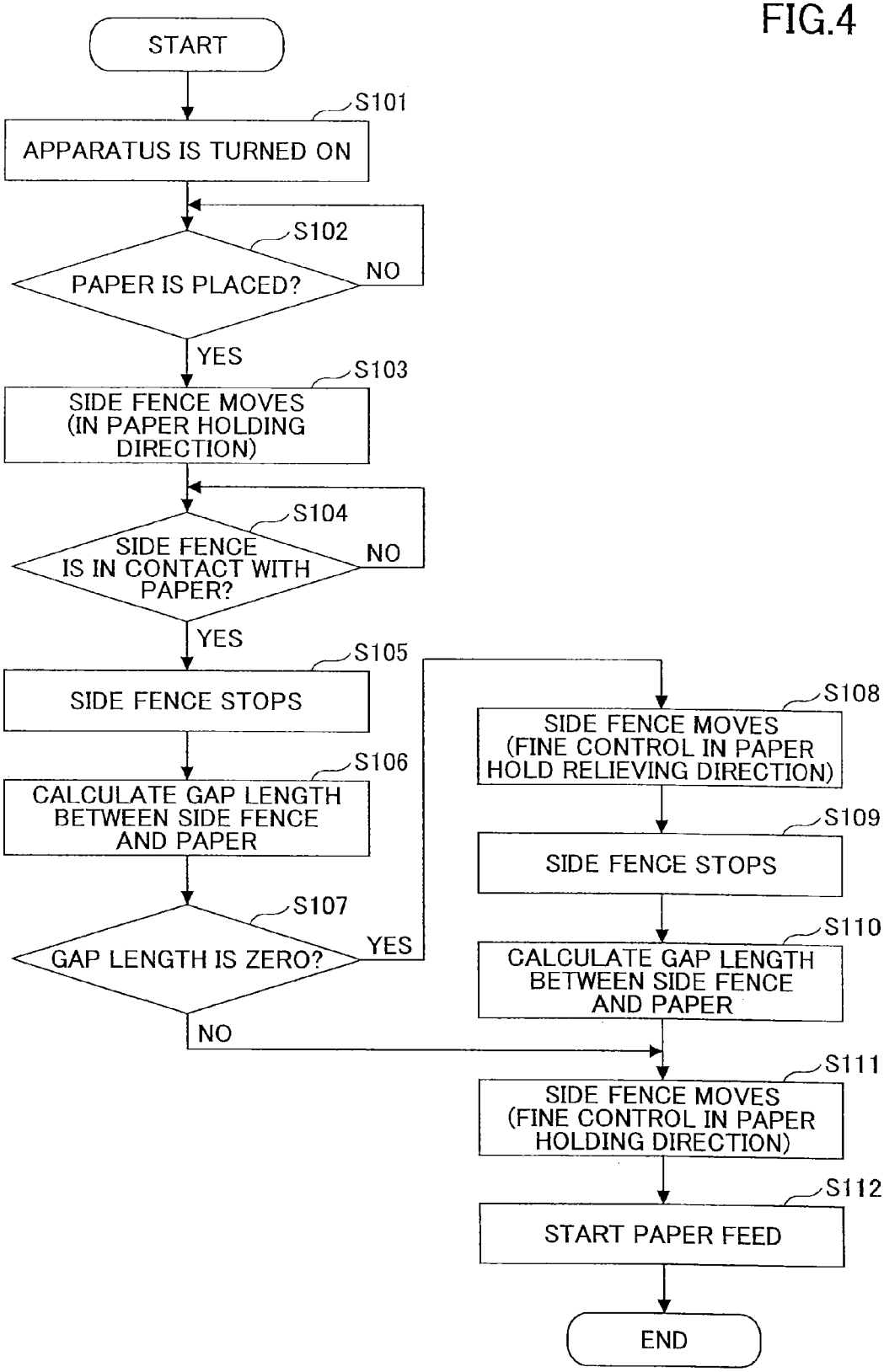
FIG. 4 is a flowchart illustrating an example of an operation of the paper placement device according to the present embodiment.

FIG. 4 is a flowchart illustrating an operation of the paper placement device according to the present embodiment. The process starts when the image forming apparatus 1 is turned on (step S101).

At first, the CPU 111 determines whether a paper is placed based on an output from the paper placement sensor 104 (step S102). When the CPU 111 determines that a paper is placed (step S102: YES), the CPU 111 rotates the side fence drive motor 103, to move the side fences 102*a* and 102*b* in the direction of holding the paper, which will be called "paper holding direction" in the following (step S103).

The paper holding direction is a direction where the side fences 102*a* and 102*b* approach the paper 6. Since the side fences 102*a* and 102*b* are configured to move the same distance in conjunction with each other in opposite directions to each other according to the rotation of the side fence drive motor 103, as described above, the paper holding direction also means a direction where the side fences 102*a* and 102*b* approach each other. That is, in step S103, the CPU 111 rotates the side fence drive motor 103 so that the side fences 102*a* and 102*b* approach each other and each of the side fences 102*a* and 102*b* approaches the paper 6.

Afterwards, the CPU 111, based on the detection output from the distance sensors 105*a* and 105*b*, determines whether the side fences 102*a* and 102*b* are in contact with the paper 6 (step S104). When the side fences 102*a* and 102*b* are in contact with the paper (step S104: YES), the CPU 111 halts the side fence drive motor 103, and thereby stops the side fences 102*a* and 102*b* (step S105). That is, the CPU 111 and the side fence drive motor 103 function as a driving unit. Here, it is determined that the side fences 102*a* and 102*b* are in contact with the paper 6 if at least one of the distance sensors 105*a* and 105*b* detect a contact with the paper 6.

Figure 5A:
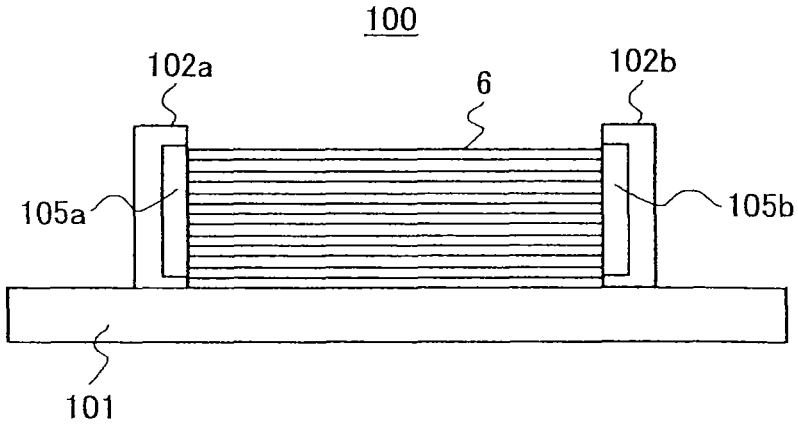
FIGS. 5A to 5C are explanatory diagrams illustrating an example of a state where side fences are stopped based on a detection output from a distance sensor in the paper placement device according to the present embodiment.
Figure 5B:
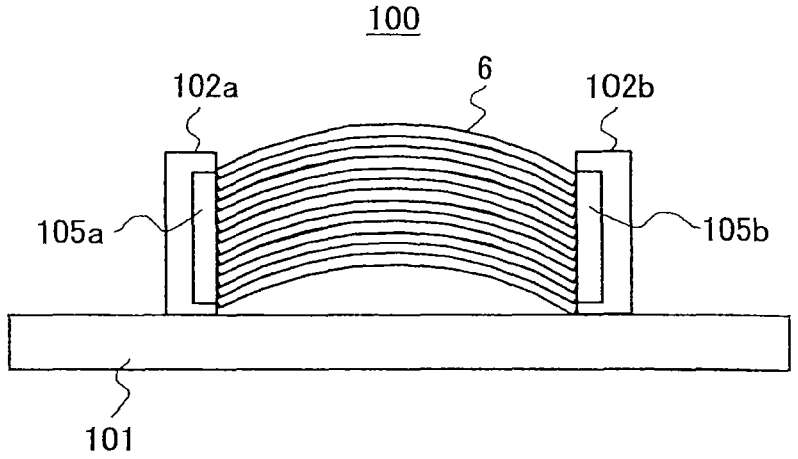
Figure 5C:
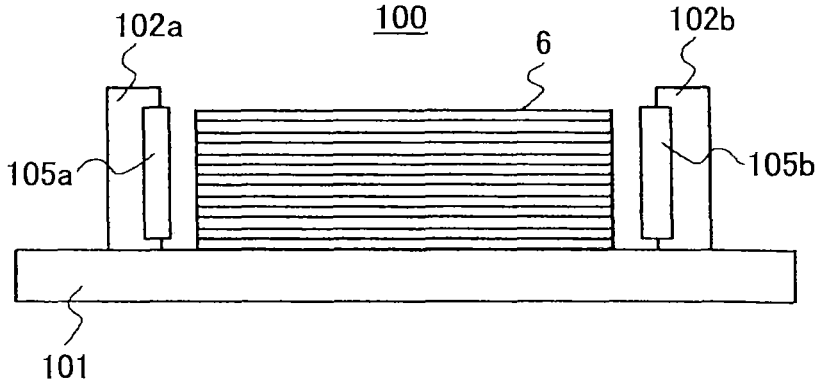

FIGS. 5A to 5C are explanatory diagrams illustrating states of the paper placement device 100 when the side fences are stopped at step S105. When the side fences 102*a* and 102*b* are stopped at step S105, an error may occur in a position where the side fence 102*a* or 102*b* is stopped due to a variation in detection time by software, a variation in detection value by the sensor or accuracy in mechanical motion, which will be described later in detail with reference to FIG. 6.

That is, even if the side fences are controlled so as to stop at adequate positions as shown in FIG. 5A, the side fences may stop beyond the adequate positions and the paper 6 may bend as shown in FIG. 5B. Furthermore, the side fences may stop before the adequate positions and the side fences 102*a*, 102*b* and the paper 6 may be separated by gaps as shown in FIG. 5C.

On the other hand, the operation of the paper placement device 100 according to the present embodiment includes processes, shown in FIG. 4, of adjusting the side fences 102*a* and 102*b* to the adequate positions even when the side fences stop at the positions as shown in FIG. 5B or 5C.

In FIG. 4, the CPU 111, based on the detection output for the positions of the distance sensors 105*a* and 105*b*, calculates lengths of the gaps between the side fences 102*a*, 102*b* and the paper 6 (step S106). The CPU 111 determines whether the calculated value (length of gap) is zero (step S107). That is, the CPU 111 functions as a gap length calculation unit.

In this stage, when the side fences stop at the adequate positions as shown in FIG. 5A or beyond the adequate positions as shown in FIG. 5B, the length of gap is zero. When the side fences stop before the adequate positions as shown in FIG. 5C, the length of gap shows a positive value.

In the case where the length of gap is not zero (step S107: NO), the CPU 111 rotates the side fence drive motor 103 by an amount corresponding to the length of gap, to move the side fences 102*a* and 102*b* in the paper holding direction (step S111). That is, the CPU 111 rotates the side fence drive motor 103 so that the side fences 102*a* and 102*b* approach each other by the length of gap. When the movement (approach) by the length of gap is completed, the CPU 111 stops the side fence drive motor 103. In the following, the operation of moving the side fences 102*a* and 102*b* in the paper holding direction by the length of gap will be called a "fine control in paper holding direction". According to the fine control in paper holding direction, the positional relationship between the side fences 102*a*, 102*b* and paper 6 including a gap, as shown in FIG. 5C, can be corrected to be the adequate positional relationship without a gap or a bend of the paper as shown in FIG. 5A.

In the case where the length of the right gap and the length of the left gap in FIG. 5C are different from each other, the length of movement for the side fences 102*a* and 102*b* is, for example, an average of them. That is, for example, when the length of the left gap is 3 mm and the length of the right gap is 1 mm, the paper 6 is shifted from the center to right by 1 mm. By moving the side fences 102*a* and 102*b* by 2 mm, which is an average of the lengths of gaps, the paper 6 is moved by the right side fence 102*b* toward the center (to the left). The lengths of left and right gaps become zero, and the adequate positional relationship can be obtained.

On the other hand, in the case where the length of gap is zero (step S107: YES), the CPU 111 rotates the side fence drive motor 103, to move the side fences 102*a* and 102*b* by a predetermined length in a direction of relieving the holding of the paper 6 (step S108), which will be called as a "paper hold relieving direction" in the following, and stops the side fences 102*a* and 102*b* (step S109). Here, the "predetermined length" is a length within a range where the distance sensors 105*a* and 105*b* can detect, which will be described later in detail.

The paper hold relieving direction is an opposite direction to the paper holding direction. That is, it is a direction where the side fences 102*a* and 102*b* move away from the paper 6. Since the side fences 102*a* and 102*b* are configured to move by the same distance in conjunction with each other in opposite directions to each other according to the rotation of the side fence drive motor 103, as described above, the paper hold relieving direction also means a direction where the side fences 102*a* and 102*b* move away from each other. That is, in step S108, the CPU 111 rotates the side fence drive motor 103 so that the side fences 102*a* and 102*b* move away from each other and each of the side fences 102*a* and 102*b* moves away from the paper 6. In the following, the operation of moving the side fences 102*a* and 102*b* in the paper hold relieving direction by the predetermined length will be called a "fine control in paper hold relieving direction".

According to the fine control in paper hold relieving direction, gaps are formed between the side fences 102*a*, 102*b* and the paper 6. That is, for example, the positional relationship without a gap as shown in FIG. 5A or 5B is changed to the positional relationship including gaps as shown in FIG. 5C.

Next, the CPU 111, in the same way as step S106, based on the detection output from the distance sensors 105*a* and 105*b*, calculates lengths of the gaps between the side fences 102*a*, 102*b* and the paper 6 (step S110). The CPU 111, based on the result of calculation, rotates the side fence drive motor 103 by an amount corresponding to the length of gap, to move the side fences 102*a* and 102*b* in the paper holding direction (step S111). According to the fine control in paper holding direction, the positional relationship between the side fences 102*a*, 102*b* and paper 6 can be adjusted to the adequate positional relationship as shown in FIG. 5A.

That is, the CPU 111 and the side fence drive motor 103 function as an adjust unit. The positional relationship of the side fences 102*a*, 102*b* and the paper 6 can be made adequate by the fine control in paper holding direction or the fine control in paper hold relieving direction and the fine control in paper holding direction, regardless of the positional relationship of the side fences 102*a*, 102*b* and the paper 6 when the process at step S105 is executed.

In the case where the side fences 102*a*, 102*b* stop at adequate positions as shown in FIG. 5A, different from the positions where the paper 6 bends as shown in FIG. 5B, a fine control is intrinsically unnecessary. However, the detection output (measured value for distance) from the distance sensors 105*a* and 105*b* is zero both in the case of FIG. 5A and in the case of FIG. 5B. The CPU 111 cannot distinguish between the case of FIG. 5A and the case of FIG. 5B. Therefore, first the side fences 102*a* and 102*b* are moved away from the paper 6 (fine control in paper hold relieving direction), to form gaps (steps S108 and S109). Then, the fine control in paper holding direction is performed by lengths of the gaps (step S111), and the positions of the side fences 102*a* and 102*b* are corrected to be the adequate positions. After the above-described fine control, the feeding of the paper 6 starts (step S112). Accordingly, a print failure or a paper feed failure arising from an inadequate positional relationship of the side fences 102*a*, 102*b* and the paper 6 can be prevented.

<Details of Fine Control>

Figure 6:
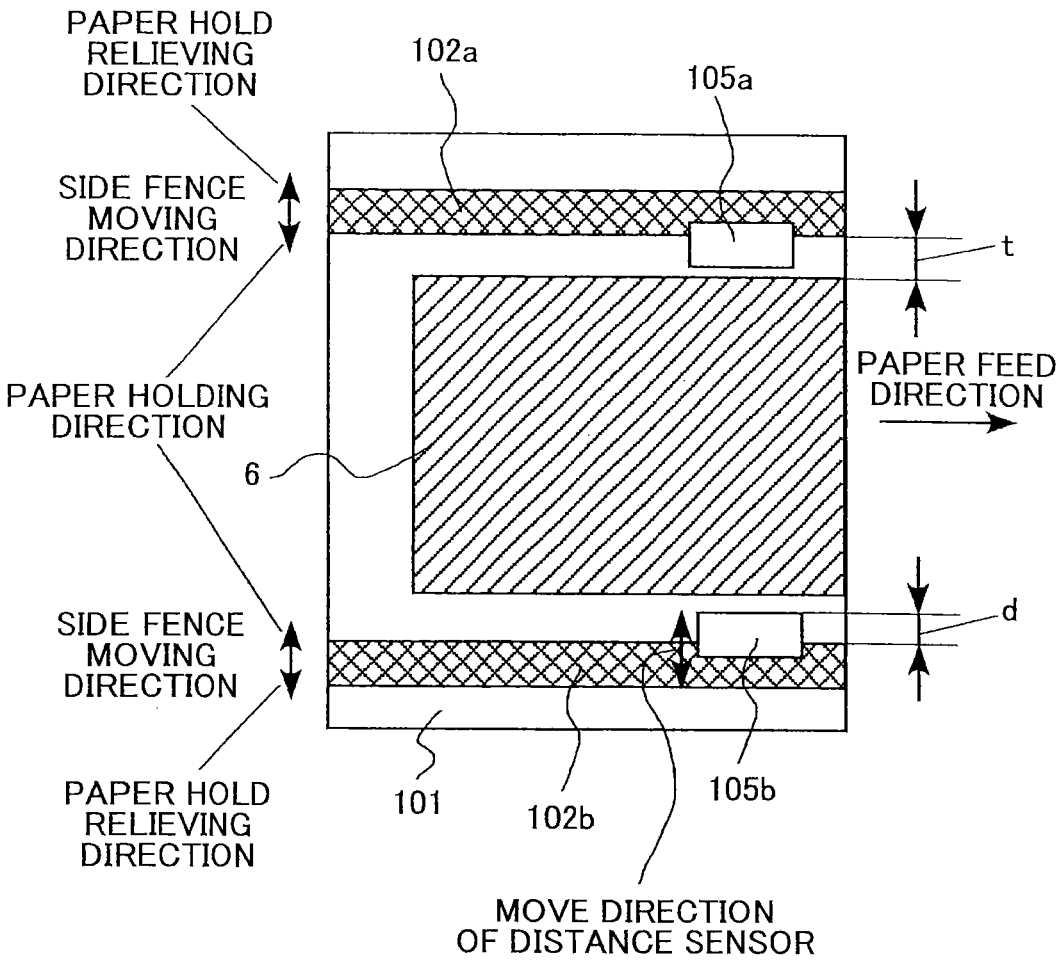
FIG. 6 is an explanatory diagram illustrating an example of a gap between the paper and the side fences in the paper placement device according to the present embodiment.

The processes at steps S108 to S111 will be explained in detail with a specific example in the following. FIG. 6 is an explanatory diagram illustrating an example of a gap between the paper 6 placed in the paper placement device 100 and the side fences 102*a*, 102*b*.

In FIG. 6, the side fences 102*a* and 102*b* can be moved in the paper holding direction and in the paper hold relieving direction by 2.5 mm. The side fences 102*a*, 102*b* move in the paper holding direction from the positions 102*a*, 102*b* at which the side fences are not in contact with the paper 6, as shown in FIG. 6. The side fences 102*a*, 102*b* stop when the distance sensors 105*a*, 105*b* detect contacts with the paper 6. In this process, the position where the side fence 102*a* or 102*b* stops is deviated from the adequate position by 1.0 mm at maximum in both directions according to a response time from an actual contact of the distance sensor 105*a* or 105*b* with the paper 6, a detection error of the distance sensors 105*a*, 105*b* and an error in the position at which the distanced sensors 105*a*, 105*b* are attached. Moreover, a movement distance d of each of the side fences 102*a*, 102*b* is 0.5 mm from when the side fence 102*a* or 102*b* makes contact with the paper 6 until the positional relationship of the side fences 102*a*, 102*b* and the paper 6 becomes adequate. In the specific example, the position at which the side fence 102*a* or 102*b* stops is in the range between a position which is located 0.5 mm (subtracting 0.5 mm from 1.0 mm) from the adequate position in the paper holding direction and a position which is located 1.5 mm (adding 0.5 mm to 1.0 mm) from the adequate position in the paper hold relieving direction.

Accordingly, in the case where the gap length calculated at step S106 in FIG. 4 is zero, i.e. the side fences stop at positions shown in FIG. 5A or FIG. 5B, by moving the side fences 102*a*, 102*b* by a distance which is longer than 0.5 mm and shorter than 1.0 mm in the paper hold relieving direction, an appropriate control can be performed for any position at which the side fences 102*a* and 102*b* stop. That is, when the side fence 102*a* or 102*b* is moved by a distance longer than 0.5 mm, a gap is necessarily formed between the side fence and the paper 6. When the side fence 102*a* or 102*b* is moved by a distance shorter than 1.0 mm, the distance sensor 105*a* or 105*b* is not in contact with the paper 6, and the gap length can be calculated at step S110.

Figures 7A, 7B, 7C:
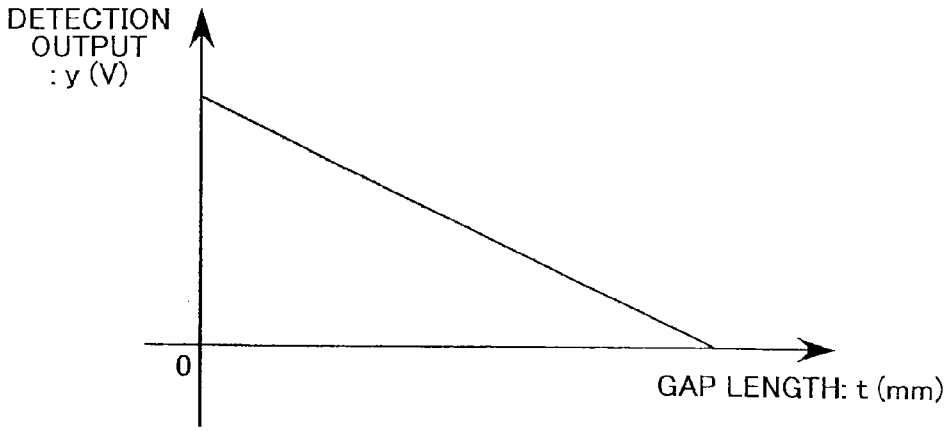
FIGS. 7A to 7C are explanatory diagrams illustrating an example of correspondence relationship between the detection output from the distance sensor and the gap between the paper and the side fence in the paper placement device according to the present embodiment.

FIGS. 7A to 7C are explanatory diagrams illustrating correspondence relationship between the detection output from the distance sensor 105*a* or 105*b* and the gap between the paper 6 and the side fence 102*a* or 102*b* in the paper placement device 100. FIG. 7A is a characteristic diagram illustrating a change of the detection output with respect to a change of the gap length. FIGS. 7B and 7C are diagrams illustrating specific examples of correspondence relations between gap lengths and detection outputs of distance sensors provided in different image forming apparatus A and B, respectively.

In the present example, the gap length between the paper 6 and the side fence 102*a* or 102*b* is denoted by t (mm), and the detection output (voltage) from the distance sensor 105*a* or 105*b* is denoted by y (V). As shown in FIGS. 7B and 7C, the detection output characteristic (linearity), which is a relation of the output value of the distance sensors 105*a*, 105*b* to the gap length between the side fences 102*a*, 102*b* and the paper 6, varies by the image forming apparatuses.

Therefore, detection outputs (voltage) y of the distance sensors 105*a*, 105*b* for known arbitrary gap lengths t between the side fences 102*a*, 102*b* and the paper 6 are measured in advance for each apparatus at plural positions. The relation of the detection output y to the gap length t is obtained, and stored in the ROM 112, which is a storage unit. For example, for the apparatus A having a corresponding relation shown in FIG. 7B, a detection output where the gap length is zero (4.0 V) and a detection output where the gap length is 3.0 mm (2.5 V) are measured, and the CPU 111 derives a relation which is data indicating the characteristic shown in FIG. 7A, i.e. "t=2 (4−y)", and stores this relation.

In this way, the CPU 111, by calibrating the detection output characteristic of the distance sensors 105*a*, 105*b* for every apparatus and by storing the relation, at steps S106 and S110, acquires the detection output of the distance sensors 105*a*, 105*b*, and calculates the gap length t by using the relation. For example, when the detection output (y) of the distance sensors 105*a*, 105*b* is 3.2 V, the gap length (t) between the paper 6 and the side fences 102*a*, 102*b* is 1.6 mm by using the relation, i.e. t=2(4−3.2).

Based on the result of calculation, in order to make the gap length between the paper 6 and the side fences 102*a*, 102*b* adequate (zero, in this example), the CPU 111 rotates the side fence drive motor 103 by an amount corresponding to the calculated gap length, to move the side fences 102*a*, 102*b* in the paper holding direction. For the side fence drive motor 103, a stepping motor is used. The CPU 111 converts the gap length between the paper 6 and the side fences 102*a*, 102*b* into a number of pulses, and controls the rotation amount for the side fence drive motor 103.

As explained above in detail, according to the paper placement device 100 of the present embodiment, after the CPU 111 detecting the contact with the paper 6 stops the movement of the side fences 102*a*, 102*b*, the gap length between the side fences 102*a*, 102*b* and the paper 6 is calculated, and based on the result of calculation, fine control is performed for the positions at which the side fences 102*a*, 102*b* stop; thereby the positional relationship of the side fences 102*a*, 102*b* and the paper 6 is made adequate. Moreover, according to the image forming apparatus of the present embodiment including the paper placement device 100 as above, a print failure or a paper feed failure arising from the inadequate positional relationship of the paper 6 and the side fences 102*a*, 102*b*, can be prevented.

Meanwhile, the present invention is not limited to the above embodiments, but following variations (1) to (3) may be made, for example.

(1) During the operation of the image forming apparatus 1, the side fences 102*a*, 102*b* may move due to vibration, and a gap may be formed between the paper 6 and the side fences 102*a*, 102*b*. The CPU 111, at each predetermined timing, for example, for every predetermined number of sheets (for example, 20 sheets) printed, or for every predetermined time interval from the power being turned on, reads out the detection output of the distance sensors 105*a*, 105*b*, calculates the gap length between the paper 6 and the side fences 102*a*, 102*b*, and performs the fine control for the side fences 102*a*, 102*b* (step S111 in FIG. 4) if the gap length is not within the predetermined range.

(2) One of the side fences 102*a* and 102*b* is controlled automatically by a motor drive, and the other is fixed or controlled manually.

(3) Both side fences 102*a* and 102*b* can be driven individually.

Further, the present invention is not limited to these embodiments, but further various variations and modifications may be made without departing from the scope of the present invention.

The present application is based on and claims the benefit of priority of Japanese Priority Application No. 2013-148867 filed on Jul. 17, 2013, the entire contents of which are hereby incorporated by reference.

What is claimed is:

1. A recording medium placement device comprising:

a placement unit in which a recording medium is placed;

a guide member provided on the placement unit and along an edge of the recording medium placed on the placement unit and movable in a first direction orthogonal to the edge so that the guide member approaches the recording medium and in a second direction opposite to the first direction, the edge being at a first position;

a distance detection unit that detects a distance between the guide member and the edge of the recording medium;

a drive unit that moves the guide member in the first direction until the distance detection unit detects that the guide member contacts the recording medium, then stops and moves the guide member in the second direction, then stops the guide member a second time;

a gap length calculation unit that calculates a length of a gap between the recording medium and the guide member when a movement of the guide member is stopped the second time using a detection output from the distance detection unit; and an adjustment unit that moves the guide member to the edge of the recording medium at the first position based on the length of the gap calculated by the gap length calculation unit.

2. The recording medium placement device as claimed in claim 1, wherein when the length of the gap calculated by the gap length calculation unit has a positive value, the adjustment unit moves the guide member in the first direction for the length of the gap calculated by the gap length calculation unit, and when the length of the gap calculated by the gap length calculation unit is zero, the adjustment unit moves the guide member in the second direction for a predetermined length to form a gap between the guide member and the recording medium, and moves the guide member in the first direction for a length of the formed gap.

3. The recording medium placement device as claimed in claim 1, further comprising:

a storage unit that stores data indicating a correspondence relation between the detection output from the distance detection unit and the length of the gap, the data being acquired in advance from detection outputs from the distance detection unit when the distance between the guide member and the edge of the recording medium is set to a plurality of arbitrary known values, wherein the gap length calculation unit calculates the length of the gap between the guide member and the recording medium using the data indicating the correspondence relation.

4. The recording medium placement device as claimed in claim 1, wherein the gap length calculation unit calculates the length of the gap between the recording medium and the guide member using the detection output from the distance detection unit detected at each predetermined timing, and the adjustment unit moves the guide member to the edge of the recording medium based on the length of the gap calculated using the detection output detected at each predetermined timing.

5. An image forming apparatus comprising:

the recording medium placement device as claimed in claim 1; and an image forming unit that forms an image on the recording medium fed from the recording medium placement device.

* * * * *